United States Patent [19]

Young

[11] 4,261,386

[45] Apr. 14, 1981

[54] SEWER RELIEF VALVE

[76] Inventor: Jack W. Young, 5510 E. 20th St., Tucson, Ariz. 85711

[21] Appl. No.: 928,731

[22] Filed: Jul. 27, 1978

[51] Int. Cl.[3] ..... F16K 1/00

[52] U.S. Cl. ..... 137/467; 4/211; 137/236 R; 137/356; 137/528; 137/800; 220/358; 220/375

[58] Field of Search ..... 4/211, 219, 295; 137/236, 356, 467, 528, 800; 138/89; 215/352; 220/308, 357, 358, 375

[56] References Cited

U.S. PATENT DOCUMENTS

| | | | |
|---|---|---|---|
| 957,487 | 5/1910 | Berry | 137/800 X |
| 1,173,422 | 2/1916 | Grannis | 220/357 |
| 2,798,504 | 7/1957 | Gast | 138/89 X |
| 3,064,739 | 11/1962 | Hanson | 220/375 X |
| 3,805,826 | 4/1974 | Westerhoff | 137/236 X |
| 3,815,629 | 6/1974 | Oberholtzer | 4/211 X |
| 3,852,836 | 12/1974 | Oberholtzer | 137/236 X |
| 3,895,466 | 7/1975 | Melton | 220/358 X |

FOREIGN PATENT DOCUMENTS

| | | | |
|---|---|---|---|
| 1046356 | 7/1953 | France | 137/356 |

*Primary Examiner*—Robert G. Nilson
*Attorney, Agent, or Firm*—J. Michael McClanahan

[57] ABSTRACT

A sewer relief valve for placement in an existing sewer line connecting a residence or other facility generating sewage and the sewage collection system, the valve comprising connection means adapted to connect into a sewer line, an adapter means in turn operably attached to the connection means, and a cap means attached in air-tight and water-tight fashion to the adapter means, the adapter means also having O-ring sealing means whereby backing up sewage and water interiorly to the sewer pipe will forcibly eject the cap means and permit exterior ground flooding rather than flooding interiorly to the residence or other sewage generating facility.

2 Claims, 2 Drawing Figures

SEWER RELIEF VALVE

BACKGROUND OF THE INVENTION

In the installation of sewer pipes connecting residence or other commercial buildings with the central sewage system, such as a city sewer line or, for that matter, septic tanks, problems will develop in the sewer line, which are exhibited by the sewer line becoming filled with sewage and waste water. These problems may be caused by the central sewer system stopping up and thereby backing into the sewer pipe leading between the residence and the sewer system, or, by the sewer pipe becoming clogged between the residence and the central collection system. In these cases, it is common for the sewage to fill the pipes back into the residence, and to leak out on the floors of the residence, providing an undesirable situation.

It is common practice in plumbing construction to locate between the residence and the central sewage collection point a "T" section in the sewer pipe, and to install in that "T" section or pipe connected thereto, a sealed plug. Then, access through this sealed plug can be had for such things as removing debris and other materials which may clog the sewer line. As a rule, this access means is buried in the ground between the residence and the central system and thus, not readily accessible. This access means also suffers from the deficiency that while it does provide access into the sewer pipe, it does not really alleviate the damage caused by the problem it seeks to repair. The location of the access means in the sewer pipe does not prevent the sewer system from over-flowing nor does it have any preventative features. It merely helps remedy the problem once it has been developed.

It is obvious then, there is a need for a device which provides all of the features of the access system, but with the additional feature that means are provided to bleed off the backing up sewage and water which otherwise would be flooding the interior of the premises where the sewer pipe ultimately connects.

SUMMARY OF THE INVENTION

Applicant's invention provides a device whereby a present existing access means in the sewer pipe between the residence or other facility and the central sewage system may be modified for bleeding off sewage that backs up, or the device may be inserted into a sewer line not having a prior existing access means, which device provides for bleeding off backing up sewage.

More specifically, means are provided to communicate with the interior of the sewer pipe through a top cap located above ground, the top cap in an air and water-tight configuration with the sewer pipe, in order that backing up sewage will forcibly eject the top cap and bleed off before the interior of the residence becomes flooded. Means are also provided by a connecting adapter for containing the air- and water-sealing means, namely by Neoprine O-rings engaging the cap.

The cap, which is nominally placed above ground, fits snuggly over the adapter connecting the sewer pipe "T" section and is forced off by the pressure of the water or sewage backing up in the sewer pipe.

It is an object therefore, to provide a means to prevent sewage flooding due to backed up sewers.

It is a further object of the present invention to provide an air-tight and water-tight means connective to a sewer line which will permit the exit of sewage in a backed up sewer line.

It is still a further object of the subject invention to provide means to bleed off backed up sewage in a sewer pipe.

DETAILED DESCRIPTION OF PREFERRED EMBODIMENT

Figure 1:
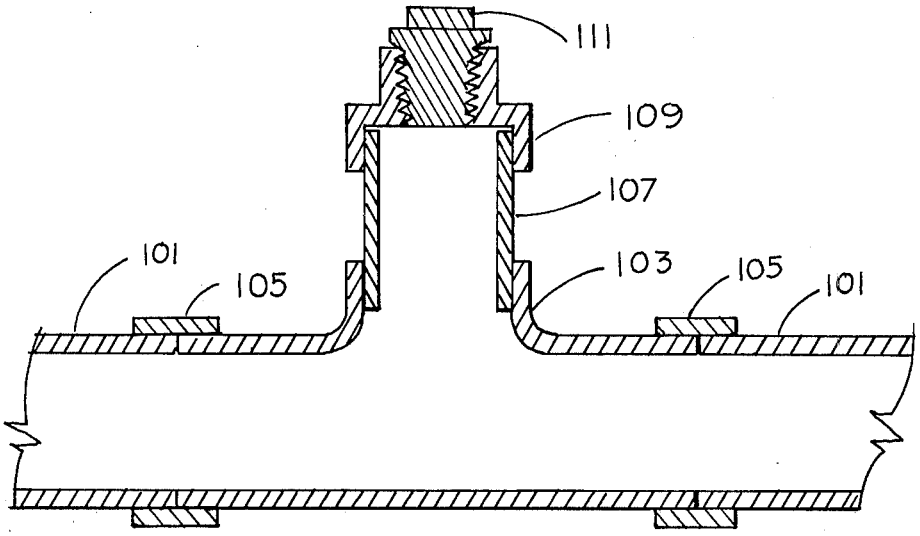
PRIOR ART FIG. 1 PRIOR ART
FIG. 1 is a cross-sectional view of the prior art showing an access plug in a sewer line.

Referring to FIG. 1, the prior art illustrating access valves or plugs which have been installed in the sewer line is shown in a cross-sectional view. Generally these access valves are located exterior to the house and in the sewer piping which runs from the house to the central street sewer line or septic tank. By this means, entrance into the sewer pipeline is afforded. Shown in cross-section is a section of the sewer pipe 101, normally four-incn sewer pipe, which has installed a "T" section 103. This "T" section 103 is secured in place in a water-tight fashion by means of overlapping sleeves 105 to which are applied the customary plastic pipe adhesive. Set into the "T" section 103 shank portion is pipe 107, nominally also a four-inch pipe. Atop the short length of pipe 107 is an adapter 109, generally a four-inch to four-inch adapter, one end of which encompasses the end of pipe 107 with the other end having converging threads screwed therein to receive plug 111, also a four-inch plug. All sleeve type connections shown in FIG. 1 have been made air tight by the application of appropriate glues or adhesives. The plug is threaded into the adapter and an air-tight seal is afforded thereby.

As had been earlier discussed, this type of prior art arrangement does not provide a means to prevent back up of sewage and water into the house in the event that the sewer pipe is clogged between the access mechanism shown in FIG. 1 and the street sewer system, or for that matter, if the street sewer system should back up. Also, as had been indicated earlier, in general construction, the access mechanism shown in FIG. 1 is buried in the yard of the home and thereby prevents access until it is uncovered.

Figure 2:
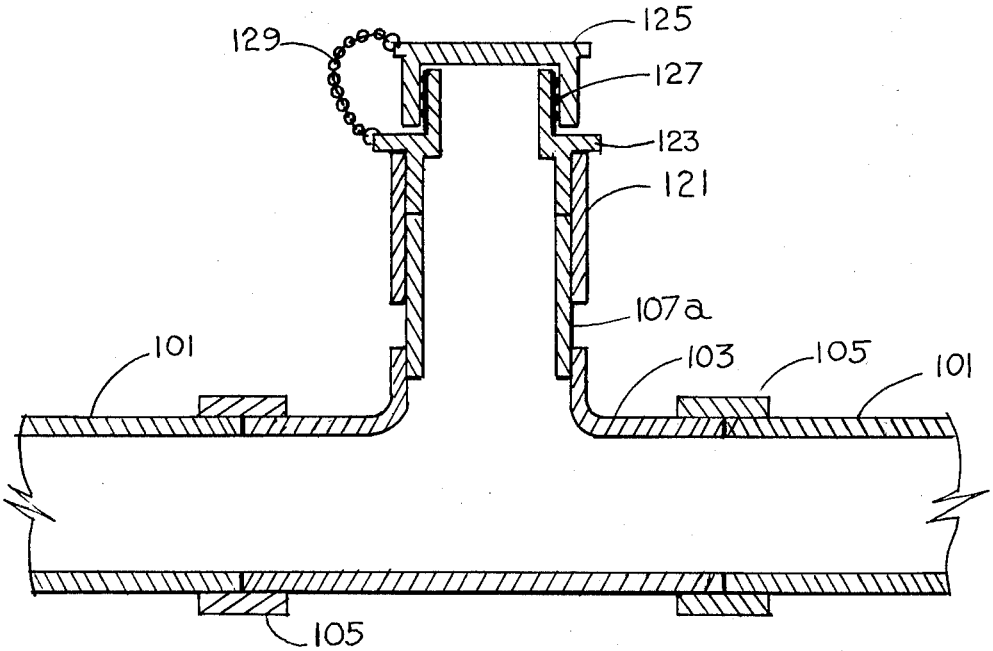
FIG. 2 is a cross-sectional view of the subject invention in place in a sewer line.

Applicant's invention, a cross-sectional view of which is shown in FIG. 2, is designed to alleviate this problem. Referring now to FIG. 2, the identical sewer pipe 101 is illustrated as well as "T" section 103. Additionally sleeve 105 is shown connecting "T" section 103 to sewer pipe 101 in a water-tight configuration, and pipe 107 is also illustrated, which has been modified and termed 107*a*. It is anticipated that the applicant's relief valve will be a modification, in many cases, of present existing access means, and this is what has been illustrated in FIG. 2. Of course, the invention is not restricted to this use, and it may be used in new construction.

Pipe 107 has been cut off at or near former adapter 109, to form pipe 107*a* and the adapter has been removed, together with plug 111. Newly added coupling 121 is affixed to pipe 107*a*, the purpose of the coupling to extend the applicant's invention above the ground level over the area in which sewer pipe 101 is buried. To the top of coupling 121 is added new adapter 123, one end of which is encompassed by the cylinder wall of coupling 121, and, the other end of which is encompassed by new cap 125. Between the inside cylindrical wall of cap 125 and the outside cylindrical wall of adapter 123 are a plurality of O-rings 127 which provide an air-tight fit of cap 125 over adapter 123. O-rings 127 are set in annular grooves cut in the outside periphery of the upper cylindrical wall of adapter 123 so that only about ½ of the O-ring circumference protrudes beyond the peripheral wall of the upper cylindrical portion of adapter 123.

Attaching to the top hat of cap 125 and the central flange of adapter 123 is loose chain 129 which merely assures that cap 125, when removed by whatever means, remains in the proximity of the adapter 123. All pipe connections are water-tight, nominally, a proper adhesive being placed at all points of different connections.

It has also been found useful to lubricate the inside cylindrical wall of cap 125 with a silicon type lubricant and MOLYKOTE 55M Grease (MOLYKOTE is a registered trademark of Dow Corning Corporation of Midland, Mich.) has been used with success. The lubricant is not necessary for the use invention; however, it has been found helpful.

In operation, the inventive relief valve works as follows. Normal placement of the relief valve is accomplished exteriorly to the home plumbing at a location between the house and the street sewer system or septic tank. In the event that there is a stoppage in the sewer pipe 101 between the relief valve and the central sewage system or septic tank, sewage and water from the home will begin to back up. The air trapped therein will rise into the relief valve and when sufficient pressure of the backed up water and sewage has accumulated, cap 125 will be eased off adapter 123. The water and sewage will continue filling the shank portion of the "T" section, and, since the cap has already been pushed off, will proceed to flood the outside grounds until the problem has been discovered and no new sewer is added to the line. Of course, it is anticipated that the cap 125 will reside at or near the outside ground level and that the level of the top of adapter 123 is below the level of the facilities connecting the sewer pipe interiorly to the building. While the flooding of the outside may not be entirely desirable, it is more desirable than having the sewage overflowing interiorly to the building.

In the event that the central sewer system has clogged up downstream, and water and sewage continues to flow into the sewer system upstream, again, as the sewage and water begins to rise in the sewer pipe between the central sewage system and the residence, here again, the relief valve functions. As the water and sewage rises in sewer pipe 101, the cap 125 will be popped off adapter 123 by the air trapped therein before the level has risen to flood interiorly to the house, and the sewage again is flooded onto the surrounding ground. Additionally, separate means may be provided, such as a trench, to carry off any flooding waters and sewage which exit the relief valve shown in FIG. 2.

In the preferred embodiment, plastic sewage pipe has been utilized, although, of course, other types of pipes and parts may be used, not excluding metal. It is realized, of course, that cap 125 shall not weigh an excessive amount, as it must be removed by air and water pressure of the water rising in "T" and relief valve section.

For ease of manufacture from present existing plumbing supplies, in the preferred embodiment, the cap 125 was constructed from a four-inch female type plug, where the interior converging threads were machined out on a lathe to present a smooth constant diameter cylindrical surface. Further, the adapter 123, which is similar to the adapter 109 illustrated in FIG. 1, had the interior converging threads in the upper cylinder machined to a constant diameter smooth interior wall. Fabrication from existing parts is not necessary for the invention as it is plain the parts can be assembled or prepared from raw materials, such as molding from dies.

While a preferred embodiment of the invention has been shown and described, it is appreciated that the scope of the invention is not to be limited except as defined in the appended claims.

I claim:

1. A sewer relief valve for installation in a sewer line between a facility generating sewage and a sewage collecting system, the valve comprising connection means adapted to connect into and become a part of the primary sewage passage portion of a sewer line, adapter means operably connected to said connection means, said adapter means also including air-tight and water-tight sealing means, said sealing means also including groove means formed in said adapter means, and flexible O-ring means residing in said groove means, and cap means operably attached to said adapter means sealing means whereby said O-ring means engaging both said adapter means and said cap means provides the air-tight and water-tight configuration in order that backing up sewage interiorly to the sewer pipe will fill said connection means and adapter means and forcibly eject the cap means and flood out of the valve rather than overflowing in the facility generating the sewage.

2. The sewer relief valve as defined in claim 1 wherein said connection means defines T-shaped pipe means, said T-shaped pipe means opposite openings aligned in the associated sewer line and T-shaped pipe means shank portion attached to said adapter means.

* * * * *